US010219601B2

(12) United States Patent
Selvi

(10) Patent No.: US 10,219,601 B2
(45) Date of Patent: Mar. 5, 2019

(54) MULTI-DIRECTIONAL GRAB HANDLE

(71) Applicant: IT LUGGAGE LIMITED, Harlow, Essex (GB)

(72) Inventor: Sedat Selvi, London (GB)

(73) Assignee: it Luggage Limited, Harlow, Essex (GB)

( * ) Notice: Subject to any disclaimer, the term of this patent is extended or adjusted under 35 U.S.C. 154(b) by 290 days.

(21) Appl. No.: 14/898,403

(22) PCT Filed: Jun. 12, 2014

(86) PCT No.: PCT/GB2014/051814

§ 371 (c)(1),
(2) Date: Dec. 14, 2015

(87) PCT Pub. No.: WO2014/199168

PCT Pub. Date: Dec. 18, 2014

(65) Prior Publication Data

US 2016/0135562 A1 May 19, 2016

(30) Foreign Application Priority Data

Jun. 12, 2013 (GB) ..... 1310408.8

(51) Int. Cl.
*A45C 13/00* (2006.01)
*A45C 13/26* (2006.01)

(52) U.S. Cl.
CPC ..... *A45C 13/26* (2013.01); *A45C 13/262* (2013.01)

(58) Field of Classification Search
CPC ..... A45C 13/26; A45C 13/262
See application file for complete search history.

(56) References Cited

U.S. PATENT DOCUMENTS 3,455,498 A * 7/1969 Gadiel ..... B65D 5/10 229/117
5,562,189 A * 10/1996 Chen ..... A45C 13/262 190/115
6,039,243 A * 3/2000 Lickton ..... A45C 7/0036 206/335

(Continued)

FOREIGN PATENT DOCUMENTS

DE 202011106290 12/2011
GB 185699 A 9/1922

(Continued)

OTHER PUBLICATIONS

PCT International Search Report, International Application No. PCT/GB2014/051814, dated Sep. 23, 2014, 4 pages.

(Continued)

*Primary Examiner* — Tri M Mai
(74) *Attorney, Agent, or Firm* — Barnes & Thornburg LLP

(57) ABSTRACT

This invention relates to an improvement enabling improved handling of the article of luggage. Articles of luggage are disclosed incorporating a variety of manipulation means 20 by which a user may manoeuvre an article of luggage 2 from a first position to a second position, the manipulation means 20 being provided on or over a top or side panel of the article of luggage, the manipulation means being provided with at least two gripping regions, the gripping regions being disposed along different axes to one another.

18 Claims, 8 Drawing Sheets

(56) References Cited

U.S. PATENT DOCUMENTS

D436,461 S * 1/2001 Walker ..... D6/671.1
6,283,260 B1 * 9/2001 Yasuda, Sr. ..... A45C 3/12 150/111
7,617,797 B2 * 11/2009 Lam ..... A01K 1/0245 119/28.5
D667,222 S * 9/2012 Sanchez ..... D3/318
8,317,205 B2 * 11/2012 Udall ..... A45C 5/14 280/47.19
8,405,981 B2 * 3/2013 Takemasa ..... G06F 1/1616 294/24
8,490,231 B1 * 7/2013 Tjoflat ..... A47C 31/08 5/703
8,556,278 B2 * 10/2013 Brittain ..... B65D 5/0227 280/37
8,636,123 B2 * 1/2014 Santy ..... A45C 5/14 190/115
D773,815 S * 12/2016 Post ..... D3/306
2005/0126873 A1 * 6/2005 Matsumoto ..... A45C 13/26 190/115
2007/0017764 A1 * 1/2007 Cheng ..... A45C 13/002 190/100
2007/0193667 A1 8/2007 Beakey
2009/0032421 A1 2/2009 Sween et al.
2011/0088987 A1 4/2011 Santy et al.
2011/0284334 A1 * 11/2011 Cheng ..... A45C 5/14 190/18 A
2012/0138403 A1 6/2012 Tong
2013/0270851 A1 * 10/2013 Konyha ..... A45F 5/00 294/142
2014/0159403 A1 * 6/2014 Kim ..... F16M 13/04 294/137

FOREIGN PATENT DOCUMENTS

JP 2001327317 A * 11/2001
WO 20130020733 A1 2/2013

OTHER PUBLICATIONS

European Search Report for Application No. 14 731 996.6-1653; dated Jul. 25, 2017; 5 pages.
Summons to attend oral proceedings pursuant to Rule 115(1) EPC for European Patent Application No. 14731996.6 dated Mar. 9, 2018; 7 pages.

* cited by examiner

MULTI-DIRECTIONAL GRAB HANDLE

CROSS-REFERENCE TO RELATED APPLICATIONS

This application is a national stage entry under 35 USC § 371 (b) of PCT International Application NO. PCT/GB2014/051814, filed Jun. 12, 2014, and claims the benefit of United Kingdom Patent Application No. 1310408.8, filed Jun. 12, 2013, both of which are expressly incorporated by reference herein.

This invention relates to an improvement in or to an article of luggage, and in particular to an improvement enabling improved handling of the article of luggage.

As is well known articles of luggage are often provided with an extendible towing handle assembly located toward a rear surface of the article of luggage whereby a traveller may tilt and tow the article of luggage on wheel assemblies provided on a lower surface of the article of luggage. The article of luggage is also provided with a top handle, typically located on a top panel of the article of luggage and extending parallel to the front and rear edges of that panel. It is also common to provide a side handle on one of the side surfaces of the article of luggage, generally located centrally and extending parallel to the front and rear edges of that side panel. Such side and top handles take many forms and are particularly useful when lifting or transferring an article of luggage from a first position to a second position, for example, when lifting the article of luggage, from the floor to a position more convenient for loading or unloading of the article of luggage.

Luggage is used in many commercial environments and often when travelling by air. Often articles of luggage are checked in for transport in the hold of an aircraft. In such instances a traveller is required to collect their articles of luggage from a baggage carousel at their destination airport.

However, the modern design of baggage carousels presents both the known top and side handles of an article of luggage to a passenger at an angle that makes it awkward, if not difficult for a passenger to remove their luggage from the baggage carousel. In the case of a heavy article of luggage this could cause unwanted strain or even injury to the passenger when seeking to retrieve their article of luggage from the baggage carousel. Further, the passenger has no choice as the top and side handles can each be gripped in only one way as each handle extends only in a single direction.

Accordingly there is a need to provide for an improved manner of handling an article of luggage. Since airlines impose weight limits on the luggage of a passenger, such an improved manner of handling should not adversely affect the requirements for keeping the weight of the article of luggage as low as possible.

According to a first aspect of the present invention, an article of luggage having a closed condition and an opened condition incorporates a manipulation means by which a user may manoeuvre the article of luggage in the closed condition from a first position to a second position, the manipulation means being provided on or over a top or side panel of the article of luggage, the manipulation means being provided with at least two gripping regions, the gripping regions being disposed along different axes to one another.

This has as an advantage that since the gripping regions are provided along different axes, the gripping regions are presented at multiple angles to the passenger thereby improving the ability of the passenger to manipulate the article of luggage more easily by selection of an appropriate gripping region, whether to move the article of luggage into a position where one of the side or top handles or both can be gripped comfortably to remove the article of luggage from a baggage carousel or to simply to move the article of luggage from the baggage carousel directly by way of the gripping means. It will be understood that similar difficulties in the handling of articles of luggage may be encountered in other forms of travel, for example in coach travel where an article of luggage needs to be transferred from within a luggage storage area toward a position where it can easily be removed from the luggage storage area.

Preferably, the manipulation means comprises an additional panel with an opening provided over or on the top or side panel of the article of luggage, whereby an edge or edges of the opening provide the at least two gripping regions.

More preferably, the opening is circular. Alternatively, the opening is elliptical. Yet more preferably the at least two gripping regions are provided along the opening at tangents to the edges of the opening.

Alternatively, the opening is rectangular. More preferably the opening is square.

Preferably the opening is provided about a handle provided on the top or side panel of the article of luggage. More preferably the width, diameter or axis of the opening along the axis of the handle corresponds to the length of the handle along said axis.

Preferably the manipulation means is secured about its edges to edges of the top or side panel of the article of luggage.

Alternatively, the manipulation means is provided with securing means to secure the manipulation means to the top or side panel of the article of luggage. More preferably the manipulation means comprises a ring or annulus.

Alternatively the manipulation means is secured at a plurality of points to the top or side panel of the article of luggage. More preferably the manipulation means comprises a profile having limbs between the plurality of points at which it secured to the top or side panel of the article of luggage.

Alternatively, the manipulation means comprises at least two straps or webbing, each disposed at an angle to the top or side panel of the article of luggage, whereby the straps or webbing provide the at least two gripping regions.

Preferably ends of the straps or webbing of the manipulation means are secured to the edges of the top or side panel of the article of luggage.

Alternatively, the manipulation means comprises at least two straps or webbing, connected by or to a central element and disposed at an angle to the top or side panel of the article of luggage, whereby the straps or webbing provide the at least two gripping regions.

Preferably, ends of the straps or webbing of the manipulation means are secured to edges of the top or side panel of the article of luggage.

Alternatively, a first end of each strap is connected to the central element. More preferably, the straps or webbing of the manipulation means are each secured at a second end to an edge of the top or side panel of the article of luggage.

Alternatively, the manipulation means is provided with first and second end regions, the manipulation means being secured to the top or side panel of the article of luggage by the first and second end regions.

Preferably, the manipulation means are secured to the top or side panel of the article of luggage by the first and second end regions alone.

More preferably the manipulation means is generally annular.

The invention will now be described, by way of example only, in relation to the attached Figures, in which FIG. 1 shows a side view of a first article of luggage in accordance with the present invention showing a first gripping region;

Figure 3:
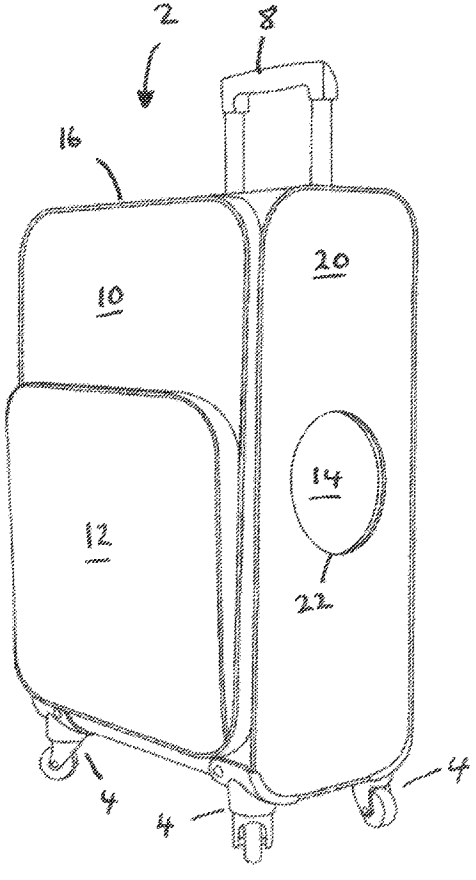
FIG. 3 shows a perspective view of the article of luggage of FIGS. 1 and 2.
Figure 2:
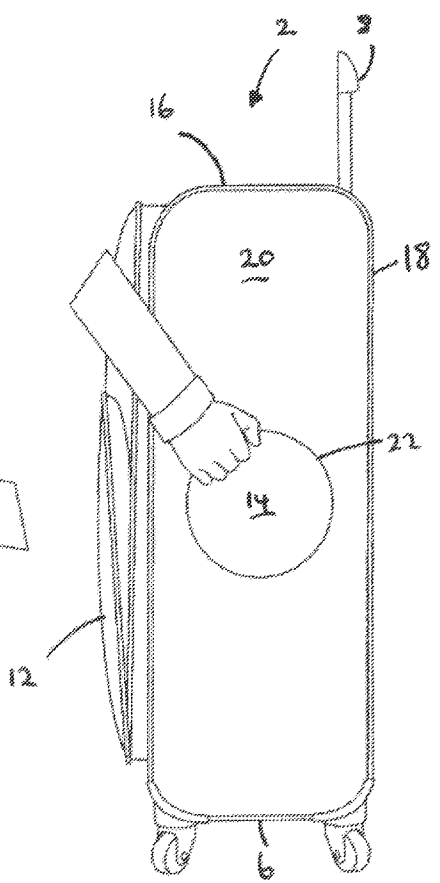
FIG. 2 shows a side view of the article of luggage of FIG. 1 showing a second gripping region.
Figure 1:
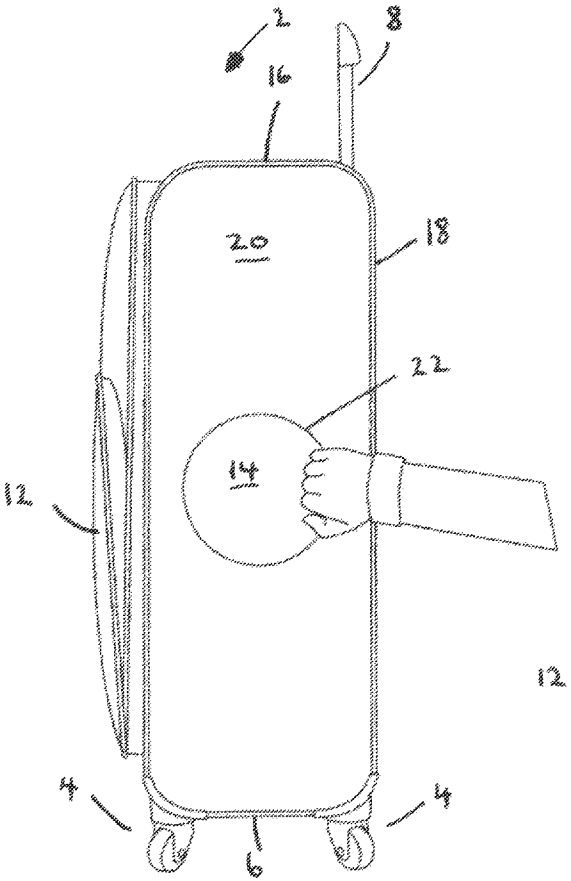

Referring first to FIGS. 1 to 3, there can be seen an article of luggage 2 in a closed condition. The article of luggage will be understood to have an opened condition whereby access may be obtained to a storage volume within the article of luggage. The article of luggage 2 stands on one end balanced upon wheel assemblies 4. The wheel assemblies 4 are connected to a base 6 of the article of luggage 2. In this description, references to front and rear, upper and lower, base and top, vertical and horizontal, or other such directional terms are to be understood in connection with the orientation of the article of luggage 2 shown in these Figures, unless the context otherwise makes this clear. Similarly like reference numerals will be used to refer to like parts. A towing handle assembly 8 can be seen located towards a rear of the article of luggage. The front surface 10 of the article of luggage is provided with an additional storage region 12. These features are provided as context for the invention and not as illustrating essential features of the invention, for example the wheel assemblies at the front of the article of luggage may be replaced with feet.

The article of luggage 2 includes a side panel 14 connected at its periphery to an upper surface 16, a rear surface 18, the base 6 and the front surface 10 of the article of luggage. A manipulation means in the form of an additional general rectangular panel 20 having a circular opening 22 is secured about its periphery to the periphery of the side panel 14.

FIG. 2 shows a passenger (or other user) gripping a first region of the opening to manoeuvre the article of luggage from a first position to a second position. The user's fingers extend around the opening 22 beneath the additional panel 20 allowing the user to tug on the additional panel 22 to move the article of luggage into a more convenient position or orientation. FIG. 3 shows a passenger (or other user) gripping another region of the opening 22 to manoeuvre the article of luggage from a first position to a second position. Conveniently the opening 22 may be provided with reinforcement around its edges. It can be seen that the two illustrated gripping regions correspond to tangents to the circular opening, the tangents being disposed at angles to one another, that is along different axes to one another.

Figure 4:
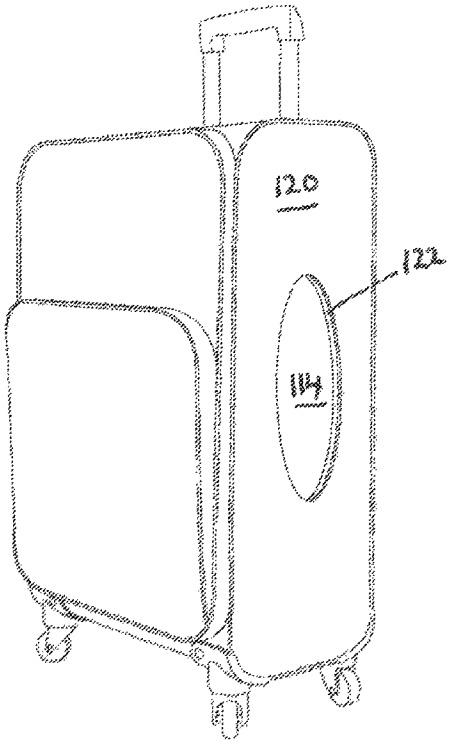
FIG. 4 shows a perspective view of second article of luggage in accordance with the present invention.

FIG. 4 illustrates a similar construction in which a manipulation means in the form of an additional generally rectangular panel 120 having a elliptical opening 122 is secured about its periphery to the periphery of the side panel 114. As with the circular opening of the previous embodiment, multiple gripping portions are provided along the opening at tangents to the edges of the elliptical opening.

Figure 5:
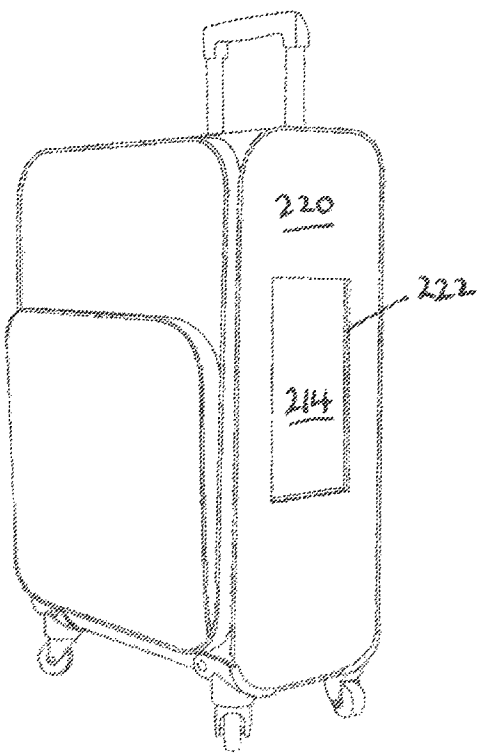
FIG. 5 shows a perspective view of third article of luggage in accordance with the present invention.

FIG. 5 illustrates a similar construction in which a manipulation means in the form of an additional generally rectangular panel 220 having a rectangular opening 222 is secured about its periphery to the periphery of the side panel 214. It can be seen that gripping portions are provided along each of the vertical and horizontal edges of the opening, such that the horizontal gripping regions and the vertical gripping regions are disposed along different axes to one another.

Figure 6:
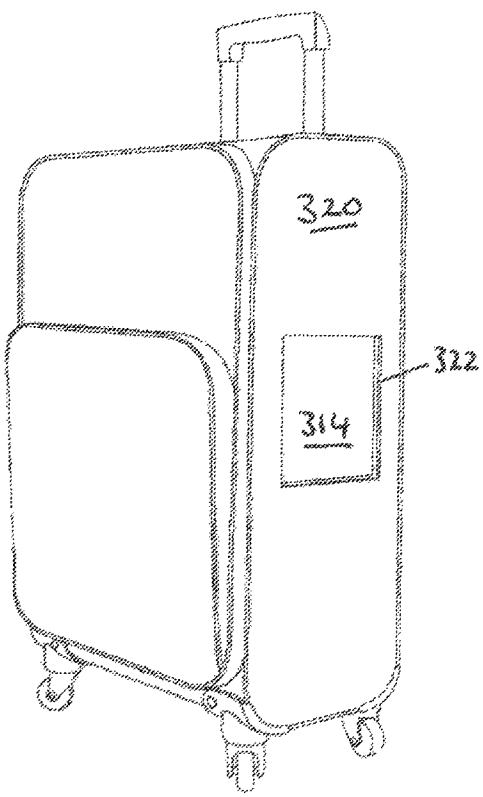
FIG. 6 shows a perspective view of fourth article of luggage in accordance with the present invention.

FIG. 6 illustrates a the case where a manipulation means in the form of an additional generally rectangular panel 320 having a square opening 322 is secured about its periphery to the periphery of the side panel 314. It can be seen that gripping portions are provided along each of the vertical and horizontal edges of the opening, such that the horizontal gripping regions and the vertical gripping regions are disposed along different axes to one another.

It will be apparent that other shapes of opening including trapezium shaped openings or other, irregular shaped openings may be used to provide the at least two gripping regions such that the first and second gripping regions are disposed along different axes to one another.

Figure 8:
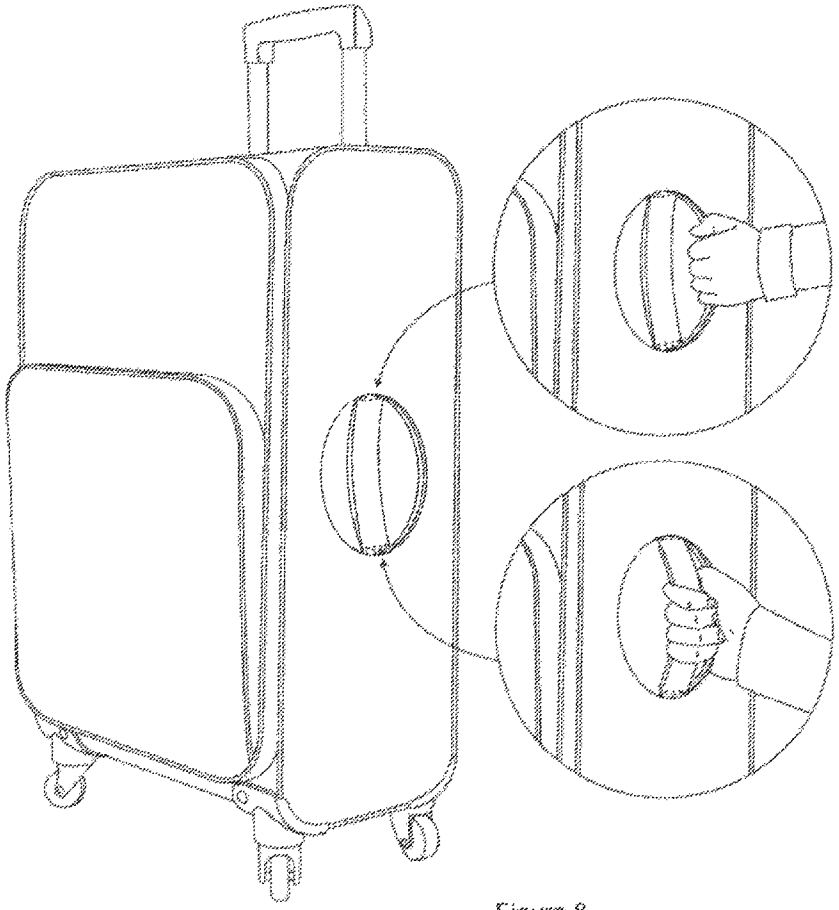
FIG. 8 shows a perspective view of the article of luggage shown in FIG. 7.
Figure 7:
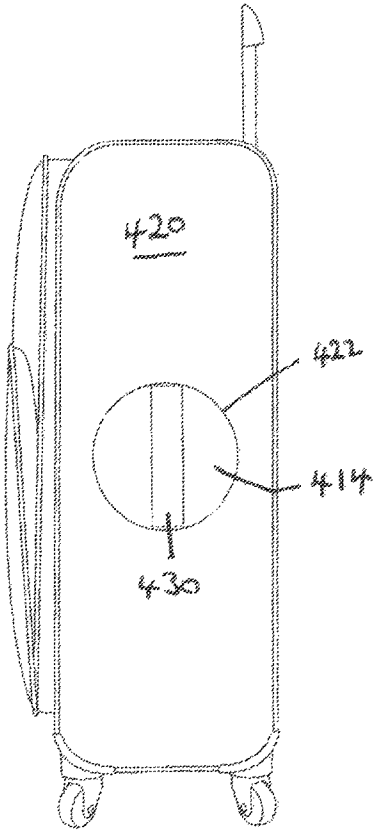
FIG. 7 shows a side view of a fifth article of luggage in accordance with the present invention.

FIGS. 7 and 8 illustrate an embodiment similar to FIGS. 1 to 3, in which a manipulation means in the form of an additional generally rectangular panel 420 having a circular opening 422 is secured about its periphery to the periphery of the side panel 414. In this embodiment, the opening 422 is located about a lifting handle 430 provided on the side panel 414. In the illustrated embodiment the diameter of the opening corresponds to a length of the lifting handle 430. The upper lower enlarged detail view in FIG. 8 shows a user gripping a first gripping region to manoeuvre the article of luggage, while the lower enlarged detail view shows a user grasping the lifting handle to lift the article of luggage.

It will be understood that each the previous embodiments may also be combined with a lifting handle, for example so that the elliptical opening is disposed about the lifting handle with the major axis of the elliptical opening corresponding to the length of the lifting handle.

In further embodiments, not shown, the width, diameter or axis of the opening is greater than the length of the handle.

Figure 10:
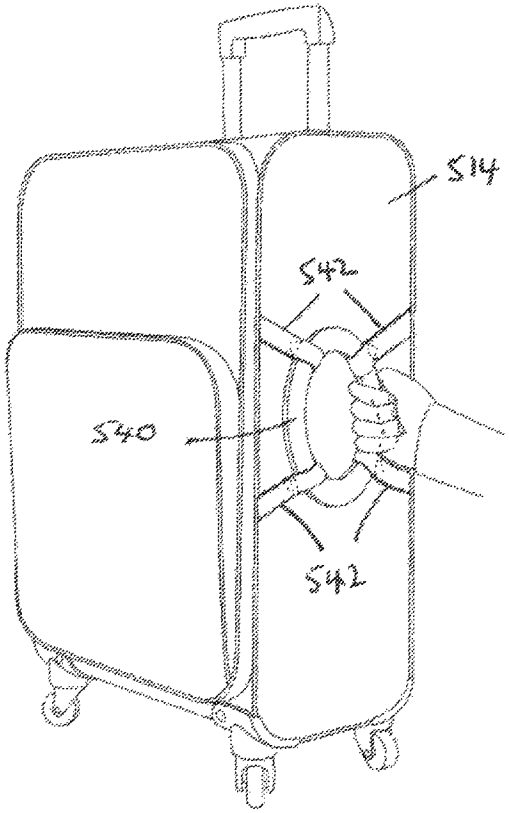
FIG. 10 shows a perspective view of the article of luggage shown in FIG. 9.
Figure 9:
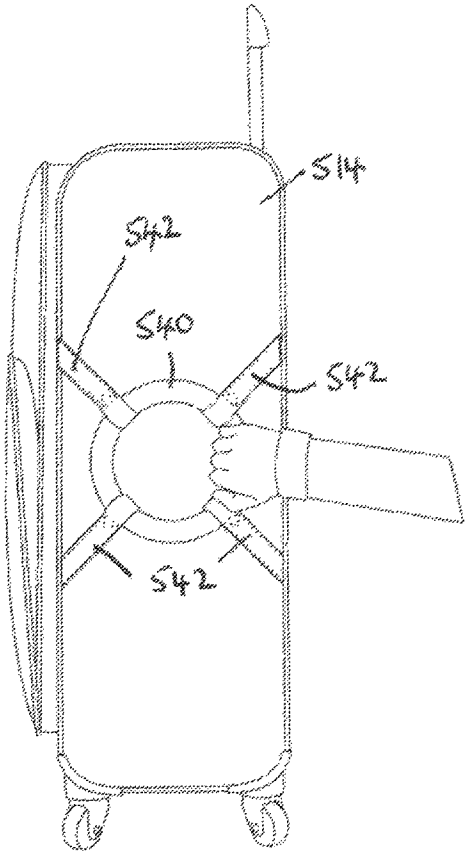
FIG. 9 shows a side view of a sixth article of luggage in accordance with the present invention.

In FIGS. 9 and 10, a manipulation means in the form of ring or annulus 540 is secured at a plurality of points to the side panel 514, whereby the ring or annulus 540 provides the at least two gripping regions. The ring or annulus 540 is secured to the article of luggage by straps or webbing 542 looped over the ring or annulus 540 and secured to a side panel 514 of the article of luggage by any suitable means, for example the straps or webbing 542 may be stitched to the side panel.

FIG. 9 illustrates how a user may grasp a first gripping region over the ring or annulus 540 with their finger between the ring or annulus 540 and the side panel 514. FIG. 10 illustrates how a user may, alternatively, grasp the first gripping region under the ring or annulus 540. Thus this embodiment, and those similar to it, has as an advantage that gripping regions of the manipulation means may be grasped in more than way from more than one direction. Again while a circular ring or annulus is illustrated other shapes of ring may be adopted.

Figure 12:
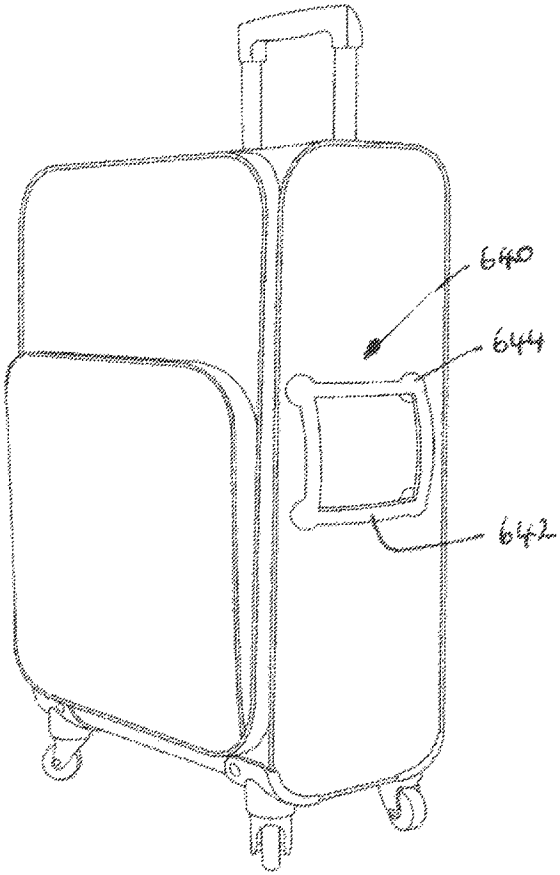
FIG. 12 shows a perspective view of the article of luggage shown in FIG. 11.
Figure 11:
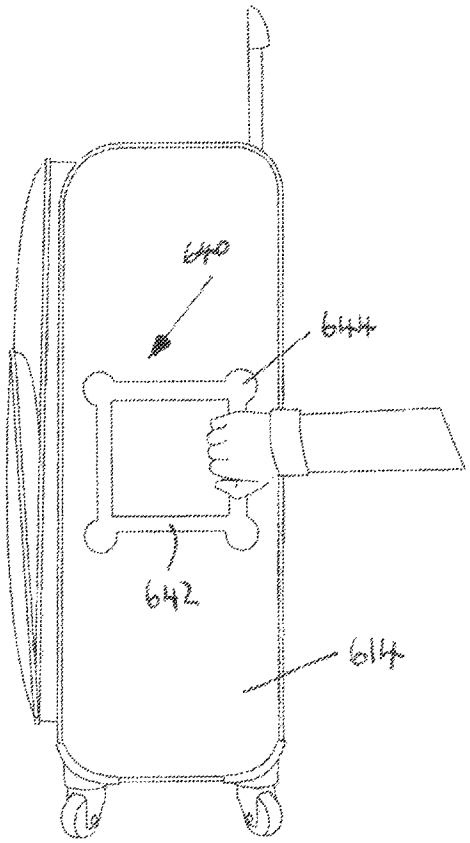
FIG. 11 shows a side view of a seventh article of luggage in accordance with the present invention.

FIGS. 11 and 12 shows a manipulation means in the form of a raised profile 640 having a plurality of limbs 642 secured at a plurality of tethering points 644 to the panel 614. In the illustrated embodiment, the raised profile 640 is of square profile when viewed full on. The illustrated raised profile 640 the tethering points 644 are at the corners of the raised profile 640. The raised profile 640 is secured in any suitable manner at the tethering points 644. The limbs 642 of the raised profile 640 between the corners are curved away from the panel 614 such that a gap is maintained between each limb 642 and the side panel 614 whereby each limb 642 provides a gripping region. It will be understood that other shapes having multiple curved limbs separated by tethering points may be provided. For example arcuate limbs may be provided to produce a raised profile in the form of a circle or ellipse.

Figure 14:
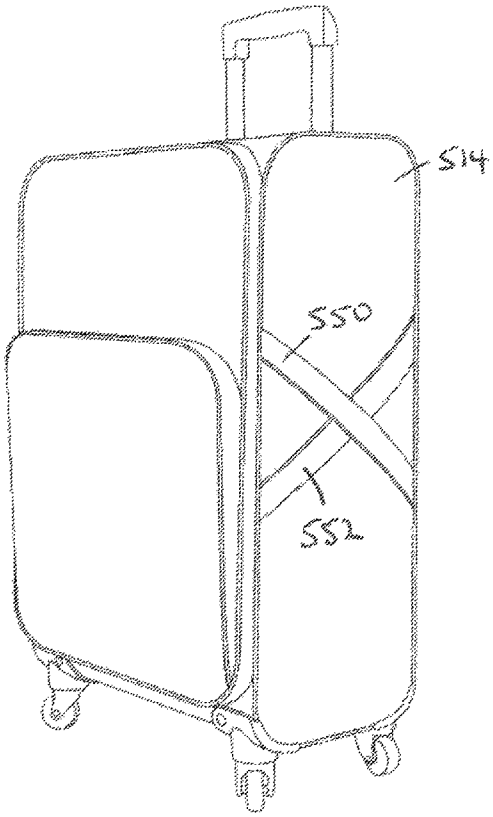
FIG. 14 shows a perspective view of the article of luggage similar to that of FIG. 13.
Figure 13:
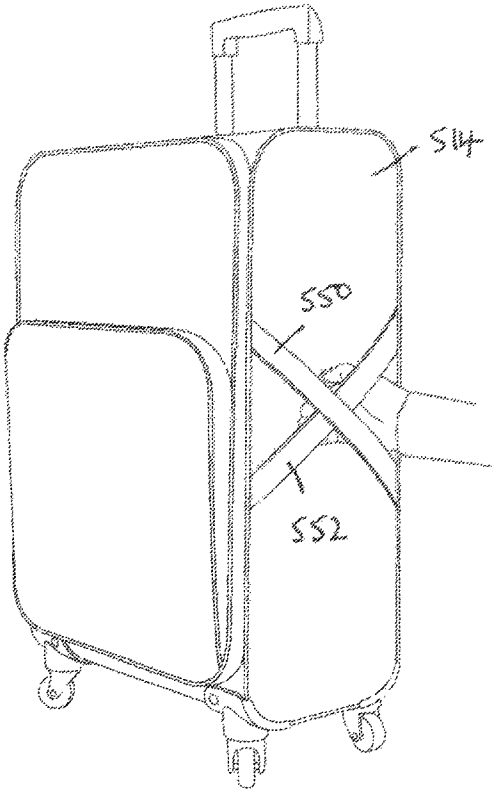
FIG. 13 shows a perspective view of an eighth article of luggage in accordance with the present invention illustrating one of the gripping positions.

FIGS. 13 and 14 show an embodiment of the present invention in which the manipulation means comprises at least two straps or webbing 550, 552, each disposed at an angle to an edge of a side panel 514 of the article of luggage, whereby the straps or webbing 550, 552 provide two gripping regions disposed at an angle to one another. The ends of each strap or webbing 550, 552 are secured to the periphery of the side panel 514 of the article of luggage. A user can grasp a single strap to provide a gripping region at an angle, conveniently an acute angle, to an edge of the side panel or grasp both to provide a gripping regions aligned with or orthogonal to (as in FIG. 13) to a side edge of the side panel.

Figure 16:
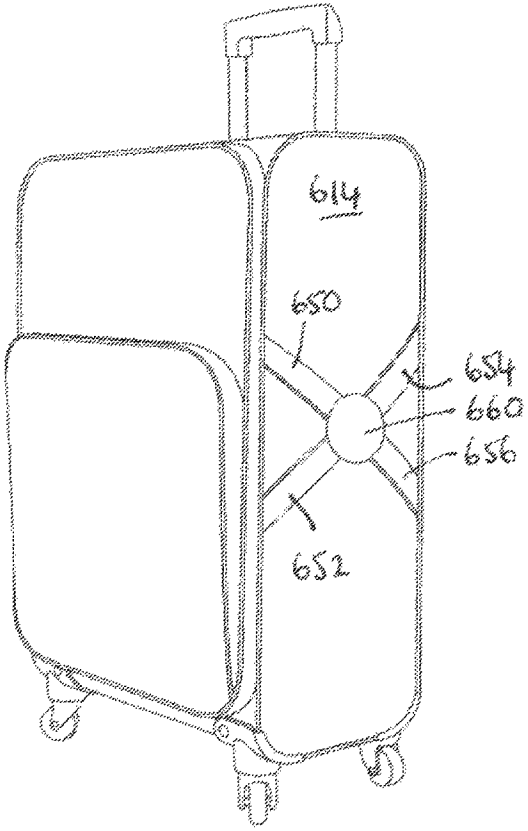
FIG. 16 shows a perspective view of the article of luggage similar to that of FIG. 15.
Figure 15:
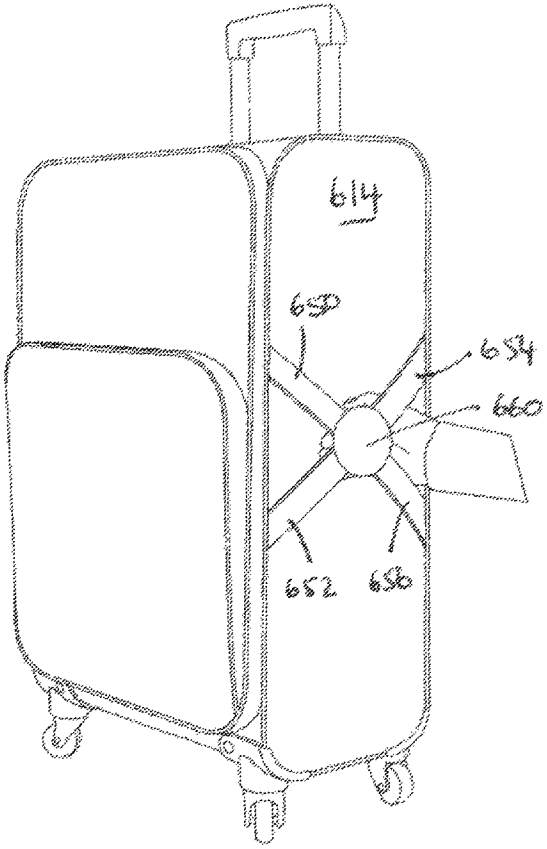
FIG. 15 shows a perspective view of a ninth article of luggage in accordance with the present invention illustrating one of the gripping positions.

FIGS. 15 and 16 show a similar embodiment in which a manipulation means comprises straps or webbing 650,652, 654,656, each connected at a first end to a central element 660 and each disposed at an angle to a side of the article of luggage, whereby the straps or webbing provide the gripping regions. The central element 660 may take any suitable form, such as for example a moulding or other article to which first ends of the straps or webbing 650,652,654,656 are secured. The straps or webbing 650,652,654,656 are each secured at a second end to an edge of the panel 614 of the article of luggage. A user can grasp a single strap or web 650,652,654,656 to provide a gripping region at an acute angle to an edge of the side panel or grasp the central element 660 to provide a gripping regions aligned with or orthogonal to (as in FIG. 15) to a side edge of the side panel.

In an alternative embodiment, the manipulation means comprises two straps or webbing, connected by or extending through the central element each of the straps or webbing being disposed at an angle to and connected at a side of the article of luggage, whereby the straps or webbing provide at least two gripping regions.

Figures 17, 18, 19:
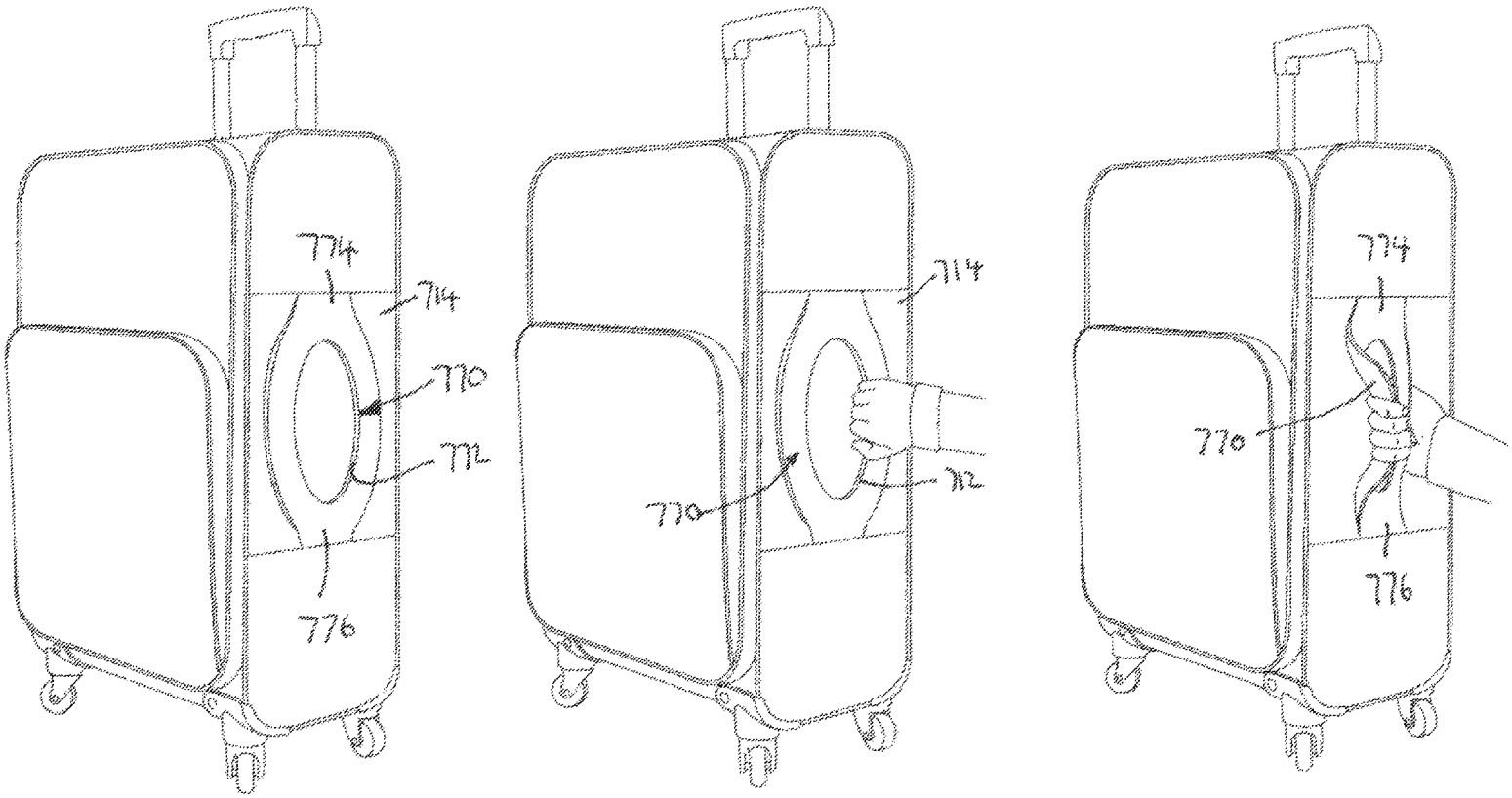
FIG. 17 shows a shows a perspective view of tenth article of luggage in accordance with the present invention.
FIG. 18 shows the article of luggage of FIG. 17 illustrating a first gripping position.
FIG. 19 shows the article of luggage of FIGS. 17 and 18 in which the manipulation means is used as a lifting handle.

In FIGS. 17 to 19, a manipulation means comprises a panel 770 with an opening 772. In the illustrated embodiment the panel 770 and associated opening 772 are generally elliptical. The panel 770 is provided next to a panel 714 of the article of luggage. The panel 770 is provided with first and second end regions 774,776, the first and second end regions 774,776 being secured to the panel 714 of the article of luggage. It should be noted that the panel 770 is secured to the panel 714 by the first and second end regions 774,776 alone.

It can be seen that the opening 772 results in a generally annular form being provided to the panel 770, with thickened regions around the first and second end regions. As may be seen in relation to FIG. 18, this embodiment provides a number of gripping regions around the opening which may be grasped by a user either from above or below. In addition, this embodiment has the further advantage that the opposing arcuate sides of the manipulation means may be folded together by a user to form a carry handle. Thus, this embodiment has as a further advantage that a separate carry handle need not be provided in addition to the manipulation means.

While the elliptical annular form of the panel 770 is preferred other shapes of the panel and the opening between the first and second ends of the panel that provide for opposing sides that fold together to form a carrying handle may be envisaged. For example, a generally rectangular panel extending from the end regions provided with a rectangular opening may be provided.

It will be understood that the various embodiments of the invention presented above also have as an advantage that they do not add, or add only marginally to the weight of the article of luggage.

While the illustrated embodiments show manipulation means provided on a side panel of the article of luggage, it will be understood that similar manipulation means can readily be provided on the top panel of an article of luggage, in addition to or instead of the side panel.

What is claimed is:

1. An article of wheeled luggage having a closed condition and an opened condition; the article of wheeled luggage comprising:

a plurality of wheel assemblies;

a side panel connected at its periphery to an upper panel, a rear panel, a base panel and a front panel of the article of wheeled luggage; and a manipulation means by which a user may manoeuvre the article of wheeled luggage in the closed condition from a first position to a second position, the manipulation means comprising an additional panel with an opening, the additional panel being provided on or over the side panel of the article of wheeled luggage and directly secured about its entire periphery to an entire periphery of said side panel of the article of wheeled luggage, whereby an edge or edges of the of the opening of the additional panel provide at least two gripping regions, the gripping regions being disposed along different axes to one another.

2. An article of wheeled luggage according to claim 1 in which the opening is circular, elliptical, rectangular or square.

3. An article of wheeled luggage according to claim 1 in which the opening is circular or elliptical and the gripping regions are provided along the opening at tangents to the edges of the opening.

4. An article of wheeled luggage according to claim 1, in which the opening is provided about a handle provided on the side panel of the article of luggage.

5. An article of wheeled luggage according to claim 4, in which a width, diameter or axis of the opening along an axis of the handle corresponds to a length of the handle along said axis.

6. An article of wheeled luggage according to claim 4, in which the handle is oriented substantially parallel with a long dimension of the side panel.

7. An article of wheeled luggage according to claim 6, in which the opening and handle are situated about midway between opposite end edges of the side panel.

8. An article of wheeled luggage according to claim 7, in which the opening and handle are situated about midway between opposite side edges of the side panel.

9. An article of wheeled luggage according to claim 1, in which the opening is situated about midway between opposite end edges of the additional panel.

10. An article of wheeled luggage according to claim 9, in which the opening is situated about midway between opposite side edges of the additional panel.

11. An article of wheeled luggage according to claim 2, in which the opening is situated about midway between opposite end edges of the additional panel.

12. An article of wheeled luggage according to claim 10, in which the opening is situated about midway between opposite side edges of the additional panel.

13. An article of wheeled luggage according to claim 1, wherein the additional panel comprises a substantially flat panel.

14. An article of wheeled luggage according to claim 13, wherein the additional panel is substantially rectangular in shape with rounded corners.

15. An article of wheeled luggage according to claim 1, wherein the side panel comprises a substantially flat panel.

16. An article of wheeled luggage according to claim 15, wherein the side panel is substantially rectangular in shape with rounded corners.

17. An article of wheeled luggage according to claim 1, in which the opening is provided with reinforcement around its edges.

18. An article of wheeled luggage according to claim 2, in which the opening is provided with reinforcement around its edges.

* * * * *